US006240972B1

(12) United States Patent
Takikawa et al.

(10) Patent No.: US 6,240,972 B1
(45) **Date of Patent: *Jun. 5, 2001**

(54) MULTI-WOUND METAL TUBE

(75) Inventors: Kazunori Takikawa, Numazu; Teruhisa Takahashi, Mishima, both of (JP)

(73) Assignee: Usui Kokusai Sangyo Kaisha Limited (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/601,432

(22) Filed: Feb. 12, 1996

(30) Foreign Application Priority Data

Feb. 15, 1995 (JP) ..... 7-050507

(51) Int. Cl.[7] ..... F16L 9/16
(52) U.S. Cl. ..... 138/154; 138/142
(58) Field of Search ..... 138/141–144, 138/150, 154

(56) References Cited

U.S. PATENT DOCUMENTS 2,373,116 4/1945 Hobrock .
2,380,107 7/1945 Hobrock .
2,746,141 5/1956 Hobrock .
5,553,640 * 9/1996 Ferenczy et al. ..... 138/154

FOREIGN PATENT DOCUMENTS 813 839 9/1951 (DE) .
0546790 * 6/1993 (EP) .
2242498 * 10/1991 (GB) .

* cited by examiner

*Primary Examiner*—Stephen F. Gerrity
(74) *Attorney, Agent, or Firm*—Anthony J. Casella; Gerald E. Hespos; Michael J. Porco

(57) ABSTRACT

An apparatus is provided for manufacturing a high quality multi-wound metal tube having satisfactory adhesion between multi-wound walls and for a seam portion at a reduced cost. Walls of the multi-wound tubular body are pressure welded with each other and then cooled, while at least the outer circumference of a brazing material between the walls of the multi-wound tubular body is kept at a flowable temperature by heating, by using at least one of a step of pressing substantially uniformly the outer circumferential surface of the tubular body in a radial direction from the outside, a step of substantially uniformly pressing the inner circumferential surface of the tubular body in the radial direction from the inside or a step of exerting a tensile force to the tubular body in the direction of the tubular axis.

2 Claims, 14 Drawing Sheets

MULTI-WOUND METAL TUBE

BACKGROUND OF THE INVENTION

1. Field of the Invention

The present invention concerns a multi-wound metal tube prepared by winding and brazing a hoop material (metal hoop material), as well as a method and an apparatus for preparing the same.

2. Description of the Prior Art

A method of preparing a multi-wound metal tube includes a method of plastically deforming a hoop material (metal hoop material) having a copper brazing material applied over the entire surface thereof into a tubular body by a forming apparatus, melting the brazing material between walls of the multi-wound tubular body by a heating device and then coagulating the molten brazing material by a cooling device to obtain a final product. Means for melting the brazing material of the multi-wound metal tube in this method includes a method of using an electric furnace and a method of ohmic heat generation by electric current supply. The method of using the electric furnace comprises cutting a metal tube formed into a multi-wound wall structure by a forming apparatus into a predetermined length and sending the multi-wound metal tubes each of a predetermined length successively into the electric furnace and melting the brazing material, while the ohmic heat generation by electric current supply comprises supplying electric current to a tubular body by way of two electrodes spaced apart from each other in the longitudinal direction of the tubular body delivered continuously from the forming apparatus, melting the brazing material by the ohmic heat generation of the tubular body and conducting brazing continuously (refer to U.S. Pat. No. 2,746,141 and German Federal Republic Patent Specification No. 813839). However, the prior method for manufacturing the multi-wound metal tube involves the following problems.

That is, abrasion of a forming tool incorporated into the forming apparatus variation of mechanical property or size of an elongate hoop material (usually longer than 1,000 m) wound in a coiled shape sometimes causes gaps between each of multi-wound walls or peeling between inner and outer seam portions, in a wall forming step. If the multi-wound metal tube is in such a state, gaps are formed in some places which hinders adhesion of the brazing layer material between each of the wound walls even after brazing, to provide poor adhesion, as well as adhesion for seamed portions is poor, failing to provide a function as a pipeline and it can not but be discarded as failed products.

FIGS. 20(A) and 20(B) are photographs showing a portion of a cross-sectional structure of a multi-wound metal tube manufactured by an existent method, in which FIG. 20(A) is a photograph showing a portion between walls and FIG. 20(B) is an enlarged photograph for an outer seam portion. As apparent from the photographs of FIGS. 20(A) and (B), in a multi-wound metal tube manufactured by the existent method, gaps are sometimes formed between wound walls in which a brazing layer is not present, to make adhesion poor, and a step is formed to an outer seam portion, which may result in a problem in view of the quality in a case where sealing performance is required between the outer circumferential surface of the tube and a rubber hose or on O-ring when the latter is fitted over the surface of the tube upon use.

Further, in the existent method, since there is no appropriate means for eliminating the gaps between each of the multi-wound walls caused in the forming step, materials have to be selected while considering the mechanical property, for example, spring back of the hoop material, which restricts the range for selecting the materials. Usually, a hoop material having a length of more than 100 m has been shaped as it is without correcting dimensional scattering for each of portions. Further, in view of the gaps between the multi-wound walls caused in the forming step, a great amount of the brazing material is required, to increase the cost for the brazing material such as copper and, in addition, this increases the thickness of the copper layer as the brazing material (refer to photograph in FIG. 20B) and there may be a worry of causing a problem of embrittlement along with increase of the copper layer, which is not preferred.

SUMMARY OF THE INVENTION

The present invention has been accomplished in view of the foregoing problems in the prior art and it is an object thereof to provide a multi-wound metal tube of high quality, with excellent adhesion between multi-wound walls and for a seam portion even if dimensional scattering is present for each of portions of an elongate hoop material, by forming the material while amending the scattering by heating, or capable of extending a range for selecting the material, capable of reducing embrittlement along with increase in the amount of the brazing layer and reducing the amount of the brazing material used, as well as a method of and apparatus for manufacturing the same.

A multi-wound metal tube according to the present invention has an aspect in which an outer seam portion is filled with a brazing material to make the entire outer circumferential surface smooth, and wound walls are entirely adhered tightly without leaving gaps to each other by the brazing material.

Further, a method of manufacturing a multi-wound metal tube according to the present invention comprises pressure-welding walls of a multi-wound tubular body with each other in a radial direction while at least the outer circumference of a brazing material between the walls of the multi-wound tubular body is kept at a flowable temperature by heating and then applying cooling.

The method also has a feature of using at least one of a step for pressing the outer circumferential surface of the tubular member substantially uniformly in a radial direction from the outside for radially pressure welding walls of the multi-wound tubular body to each other, a step of pressing the inner circumferential surface of the tubular body substantially uniformly in the radial direction from the inside or a step of exerting a tensile force to the tubular body in a direction of the tubular axis.

The method has a further feature of conducting primary cooling simultaneously or as rapidly as possible after the pressure welding in the radial direction and further conducting secondary cooling.

It has a still further feature of quenching the brazing material in the flowable state approximately to a coagulation point of the brazing material by the primary cooling conducted simultaneously with or as rapidly as possible after the radial pressure welding.

It has a still further feature of applying heating by using a brazing furnace, an ohmic heating device or a high frequency heating device. Further, the ohmic heating device has a feature of using a DC power source.

Further, an apparatus for practicing the method according to the present invention comprises a forming apparatus for forming a hoop material into a multi-wound tubular body, a heating device for melting a brazing material present between walls of the multi-wound tubular body and a cooling device for coagulating the molten brazing material and cooling the tubular body, wherein the apparatus comprises at least one means for radially pressure welding walls of the multi-wound tubular body to each other in a radial direction so as to flow the brazing material between the inside of the heating device and the inlet of the cooling device.

Further, the pressure welding means comprises at least one of means for pressing the outer circumference of the tubular body substantially uniformly in the radial direction from the outside, or transfer speed varying means for exerting a tensile force on a tubular body in the direction of the tubular axis.

Further, the pressure welding means from the outside comprises one or more sets of press rolls or one or more dies.

The pressure welding means from the inside comprises a plug or mechanical pipe enlarging head incorporated for enlarging the diameter of the multi-wound tubular body.

Further, the transfer speed varying means for exerting the tensile force in the direction of the tubular axis comprises one or more sets of tubular body pressing rolls and a set of pinch rolls in adjacent to the downstream of the pressing rolls, and enlarging the diameter of the pinch roll greater than that of the pressing roll or increasing the rotational speed of the latter.

On the other hand, the cooling device comprises a primary cooling means for quenching the brazing material approximately to the coagulation point and a secondary cooling means for cooling the tubular body approximately to a room temperature.

The primary cooling means comprises at least a cooling medium spray nozzle disposed so as to cool the outer circumferential surface of the multi-wound tubular body. The set of the pressing rolls have a three roll structure and the radius of curvature for the groove of the pressing roll is equal with or slightly smaller than the radius of curvature for the outer diameter of the multi-wound tubular body.

In the present invention, an outer circumferential surface of a multi-wound tubular body is pressed substantially uniformly in the radial direction from the outside by a pressure welding means comprising one or more set of rolls or one or more dies, or the inner circumferential surface of the tubular body is pressed substantially uniformly in the radial direction from the inside by a pressure welding means comprising, for example, a plug or a tube diameter enlarging head or changing the transfer speed of the tubular body by a transfer speed varying means comprising one or more sets of tubular body pressing rolls and set of pinch rolls in adjacent with the downstream of the pressing rolls thereby applying a tensile force to the tubular body in the direction of the tubular axis, to form a diameter-reducing force to the tubular body while at least the outer circumferential surface of the brazing material between rolls of the multi-wound tubular body is kept at a flowable temperature by heating thereby pressure welding the walls to each other in the radial direction, so that the walls are pressure welded with each other in a molten state of the brazing material, and gaps in which the brazing layer is not present between each of the walls are reduced and the brazing material is squeezed out upon pressure welding to fill the outer seam portion thereby reducing or filling the step to make the entire circumferential surface substantially smooth.

When the pressure welding means comprises pressing rolls or dies pressing from the outside, the roll or the dies is constituted as a water cooling type. If the pressure welding means is a plug pressing from the inside, the plug is constituted as a water-cooling type. Alternatively, when the pressure welding means comprises a transfer speed varying means comprising the tubular roll pressing rolls and the pinch rolls, a cooling medium spray nozzle is disposed as the primary cooling means, whereby the brazing material kept at a flowable temperature is quenched approximately to the coagulation point of the brazing material, so that sag of the brazing material (brazing sag) can be prevented, the pressure welded state can be maintained between the walls and the crystal grain growth of the substrate material can also be suppressed.

As the pressure welding means for pressing from the outside, a method of using a current supply roll may be considered for instance. However, since the current supply roll is made of a copper alloy for stably supplying electric current, it is poor in the abrasion resistance and has low resistance to high temperature oxidation and has high temperature strength. Then, if the current supply roll is used as the pressure welding means for the multi-wound tubular body, errors are caused to the circularity and the dimensional accuracy of the tubular body due to abrasion or deformation and the roll life is extremely shortened, which is difficult for practical application. Therefore, in accordance with the present invention, a method of providing a pressure welding means for the tubular body is disposed separately such that rolls or dies used exclusively for pressing made, for example, of a superhard alloy (WC) having high abrasion resistance, a high temperature oxidation resistance and a high temperature strength can be used without considering electric conductivity.

In the present invention, the flowable temperature of the brazing material is, for example, 800 to 1200° C. for a copper brazing material based on copper or copper alloy, 875 to 890° C. for a nickel brazing material (Ni-P system) and 500 to 600° C. for an aluminum brazing material (standard type).

Further, the hoop material includes iron (SPPC or the like), stainless steel (SUS 304, SUS 316, or the like), copper (C 1220 R, C 1660 R, NCuR or the like) and aluminum (A-3003, A5052 or the like).

The heating temperature for the tubular body is determined in accordance with the brazing material and the hoop material such that the brazing material is made flowable and abrupt degradation is not caused to the substrate material (hoop material).

In accordance with the present invention, since one end of the outermost wall of the multi-wound metal tube is pressed by the pressure welding means in a state where the brazing material is heated to attain flowability, it fits the inner wall even if the size scatters between each of the portions of the elongate hoop material to prevent peeling and improve the adhesion of the outer same portion.

Further, since the multi-wound tubular body is pressure welded by pressing rolls or dies of a water cooling structure or a plug of a water cooling structure from the outside or inside, the multi-wound tubular body can be quenched (primary cooling) as rapid as possible. Instead of the water cooling type pressing rolls or dies or a plug, or in combination therewith, the outer circumferential surface of the multi-wound tubular body can be quenched by a cooling medium spray nozzle disposed immediately after the pressing rolls or dies, or the plug as the primary cooling means. Also in this case, brazing sag can be prevented to maintain the pressure welded state between the walls and crystal grain growth can also be suppressed.

In accordance with the present invention, since the walls are pressure welded with each other again after or during releasing of the stresses to the substrate material by heating, there is no requirement for selecting the material in view of the mechanical property such as spring back, as well as the adhesion between the walls and for the seam portion of the multi-wound tube is satisfactory even if the size varies between each of the portions of an elongate hoop material, so that a multi-wound tube at high quality can be manufactured.

Further, since brazing is applied in a state where the walls of the multi-wound metal tube are pressure welded with each other in the radial direction, the thickness of the brazing material layer can be reduced.

DETAILED DESCRIPTION OF PREFERRED EMBODIMENTS

At first, a first embodiment of the present invention is to be explained with reference to FIG. 1 to FIG. 8.

Figure 1:
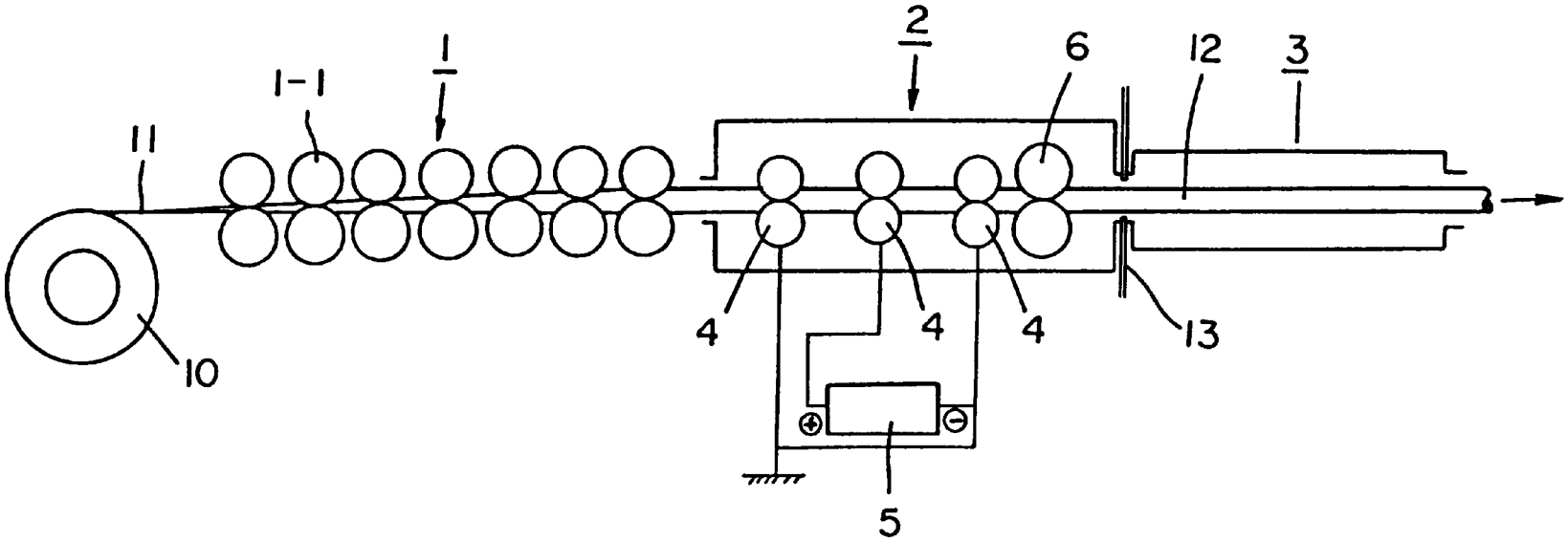
FIG. 1 is a schematic view illustrating an entire constitution of an apparatus as an example of a first preferred embodiment according to the present invention.
Figure 2:
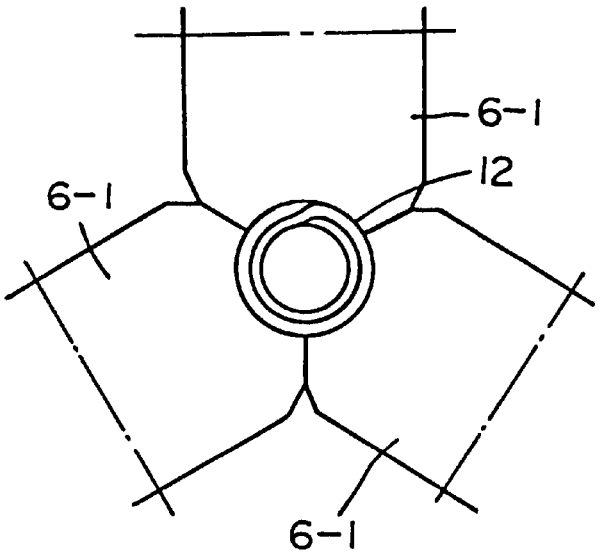
FIG. 2 is a schematic enlarged view illustrating of press forming rolls for a multi-wound metal tube in the apparatus described above.

FIG. 1 is a schematic view illustrating an apparatus as an example of a first preferred embodiment for pressing and pressure-welding the outer circumferential surface of a multi-wound tubular body in a radial direction from the outside, FIG. 2 is a schematic enlarged view illustrating of press-forming rolls for a multi-wound metal tube in the apparatus described above and FIG. 3 is a side elevational enlarged view in vertical cross section illustrating dies as a pressure welding means from the outside for a multi-wound metal tube in the apparatus described above, wherein are shown a multi-wound tube forming apparatus 1, a heating device 2, a cooling device 3, an electric current supply roll (rotary electrode) 4, a DC power source 5, press forming rolls 6 as a pressure welding means, dies 7 as pressure welding means, an uncoiler 10, a hoop material (metal hoop) 11, and a multi-wound tubular body 12.

In this embodiment, the multi-wound tube forming apparatus 1 comprises, for example, a multi-stages of forming rolls 1-1, and has a structure of continuously forming a hoop material 11 uncoiled by the uncoiler 10 into a cylindrical form. Further, the heating device 2 adopts an ohmic heat generating system comprising, for example, a plurality pairs of current supply rolls (rotary electrodes) 4 that are spaced appropriately from each other in a line direction in FIG. 1. A non-oxidative atmosphere or a reducing gas atmosphere is present in the inside of the heating device.

The pressure forming roll 6 is of a 3-roll type structure comprising three rolls 6-1 as one set, and has a structure of uniformly pressing, radially from the outside, the outer circumferential surface of the multi-wound tubular body 12 formed in the forming apparatus 1. The radius of curvature for the groove of the forming roll 6 is made equal with or slightly smaller than the radius of curvature for the outer circumference of the multi-wound tubular body, that is, the final roll of the multi-wound forming apparatus 1, so that a pressing force can be exerted uniformly on the multi-wound tubular body. Further, the pressure forming roll 6 can be constituted as a water-cooling structure for adapting it as a primary cooling means for cooling the multi-wound tubular body as rapidly as possible and the brazing material in a molten state is quenched approximately to the coagulation point, preferably, below the coagulation point of the brazing material by the pressure forming roll 6 of the water cooling structure.

Figure 3:
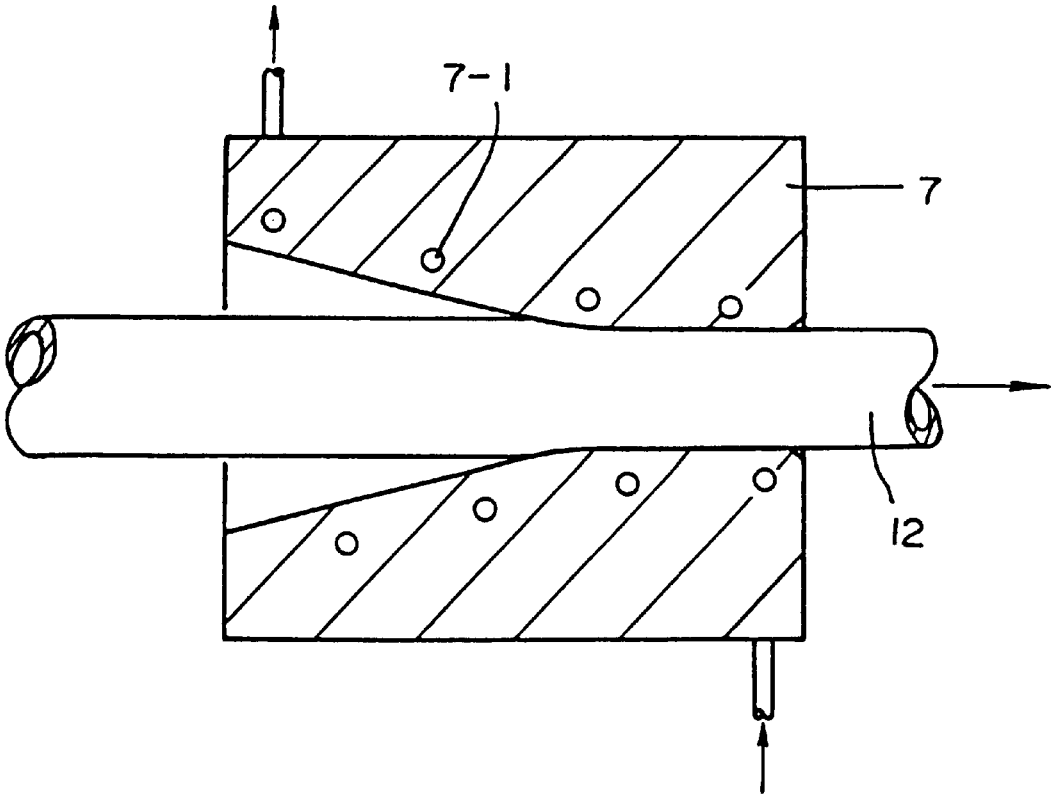
FIG. 3 is a side elevational enlarged view in a vertical cross section illustrating dies as other pressure welding means for a multi-wound metal tube in the apparatus described above.
Figure 4:
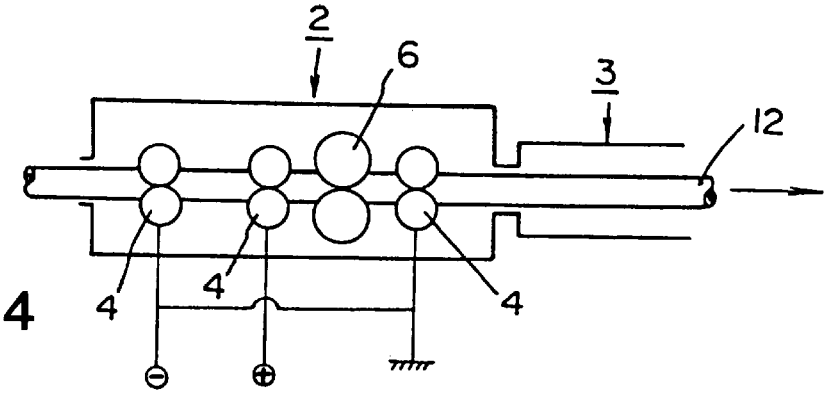
FIG. 4 is a schematic view of a heating device illustrating an example of changing a place for disposing press forming rolls in the apparatus described above.

Further, dies 7 are used in place of the pressure forming roll 6, and as shown in FIG. 3, it has a structure of uniformly pressing, radially from the outside, the outer circumferential surface of the multi-wound tubular body formed by the forming apparatus 1, like that the pressure forming roll 6. The dies are also preferably constituted as a water cooling structure by providing cooling water channels 7-1 to the inside for cooling the multi-wound tubular body to quench approximately to the coagulation point of the brazing material at the same time with pressure welding.

Since pressing has to be started while the brazing material between the walls of the multi-wound tubular body is still in the molten state, the pressure forming rolls 6 or the dies 7 are set at a location between the inside of the heating device 2 and the inlet of the cooling device 3.

The cooling device 3 is disposed at the downstream of the pressure forming rolls 6 or the dies 7, and has a structure having a plurality of cooling medium spray nozzles (not illustrated) so as to quench the brazing material in the molten state approximately to the coagulation point of the brazing material and uniformly cool the outer circumference of the multi-wound tubular body. Specifically, the device used comprises a cooling jacket having a plurality of nozzle apertures disposed at the inner circumference, such that a cooling medium is blown from the nozzle apertures to the multi-wound tubular body passed through the jacket. As the cooling medium, a gas such as an inert gas or a reducing gas is generally used but a liquid such as a heat transfer oil or water can also be used.

As a primary cooling means for conducting cooling as rapidly as possible after pressure welding, a cooling medium spray nozzle 13 may be disposed just after the forming rolls 6 in addition to the water cooling type pressure forming rolls or dies to quench the brazing material approximately to the coagulation point by spraying the coolant from the nozzle.

As described above, the cooling device preferably includes the primary cooling means comprising the water cooling type forming rolls or dies or the cooling medium spray nozzle and the secondary cooling means comprising the cooling device disposed at the downstream of the roll or the like, but quenching approximately to the coagulation point of the brazing material and cooling for the multi-wound tubular body can be conducted also in the cooling device 3.

In the apparatus for manufacturing the multi-wound tube described above, a hoop material (SPCC) 11 is applied, for example, with a copper brazing material at least to a portion of forming an overlapped surface upon winding, preferably, over the entire area of one surface is uncoiled from the uncoiler 10, formed into a tubular body having, for example, double walls in the multi-wound tube forming apparatus 1 and introduced into the heating device 2.

In the heating device, electric current is supplied from a DC power source 5 by way of a plurality pairs of electric current supply rolls 4 and the brazing material between the walls is melted by the ohmic heat generation of the tubular body. Since the brazing material is copper, the temperature is 1,080 to 1,200° C.

Successively, the multi-wound tube is pressed uniformly and radially from the outside by the pressure forming rolls 6 or the dies 7 in a molten state of the brazing material, and the walls of the multi-wound pipe are pressure welded with each other in the radial direction. Since the brazing material between each of the walls is still in the molten state, it prevails between the walls by the pressing action of the pressure forming rolls 6 to reduce gaps in which the brazing material is not present and the brazing material is squeezed out to an outer seam portion thereby filling the portion with the brazing material to reduce or eliminate the step. Further, since one end of the outermost wall (seam portion) of the multi-wound tubular body is forcedly pressed by the pressure forming rolls 6 or the dies 7. It fits and closely adheres with the inner wall to prevent peeling of the outer seam portion.

Further, since the pressure forming rolls 6 preferably have the water cooling structure, the multi-wound tube is quenched simultaneously with pressure welding, and the molten brazing material is quenched approximately to the coagulation point and preferably below the coagulation point of the brazing material. The brazing sag can be prevented by such primary cooling effect, by which pressure welded state between each of the walls is maintained and crystal grain growth is suppressed.

The multi-wound tubular body 12 delivered from the heating device 2 is subjected to secondary cooling by the cooling device 3 disposed at the downstream of the pressure forming rolls 6 or the dies 7, by which the outer circumferential surface of the multi-wound tubular body is cooled and the brazing material between each of the walls is coagulated thoroughly to complete brazing.

Further, in the apparatus for manufacturing the multi-wound metal tube, the pressure welding means such as the pressure forming rolls 6 or the dies 7 is not necessarily disposed just after the final current supply roll 4 but a similar effect can also be obtained by disposing the means, for example, between the final current supply roll 4 and other current supply roll 4 before or after the roll 4.

Figure 5:
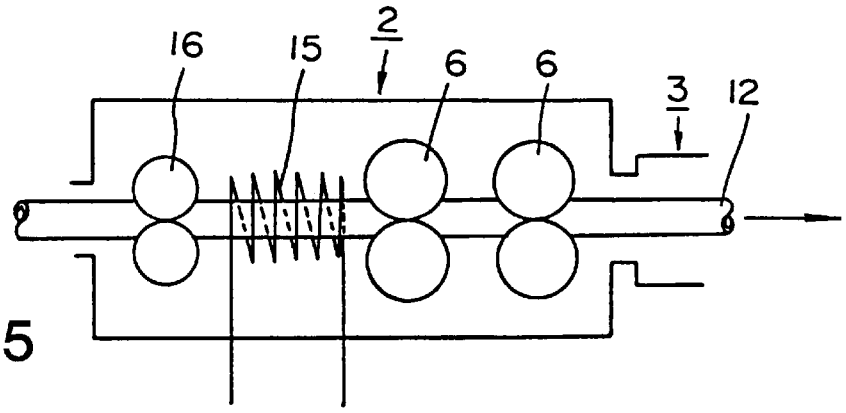
FIG. 5 is a schematic view of a heating device illustrating other heating means of a multi-wound tubular body in the apparatus described above.

As the heating means for the multi-wound tubular body 12, a high frequency heating coil 15 may be adopted, as shown in FIG. 5, instead of the ohmic heat generation system. In this case, since the electric current supply rolls are not necessary, it may be suffice to dispose only the guide rolls 16 at the inlet of the heating device. Further, as the heating means for the multi-wound tubular body, a usual heating furnace known, for example, in JP-B-2904613 may be used as a brazing furnace.

Figure 6:
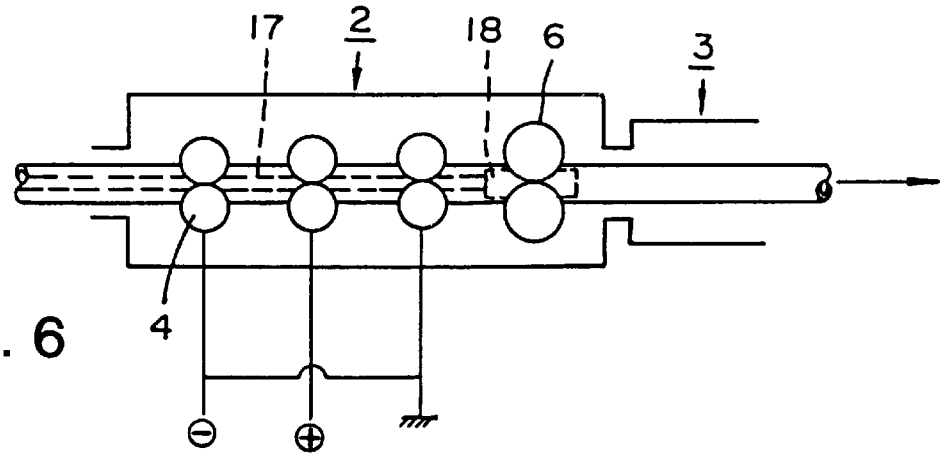
FIG. 6 is a schematic view illustrating an example of a means for supporting an inner circumferential surface in a multi-wound tubular body in the apparatus described above.

Further, means for supporting the inner circumferential surface of the tubular body corresponding to the pressure forming rolls 6 or the dies 7, for example, means that supports by a plug 18 attached to the top end of a rod 17 as shown, for example, in FIG. 6 may further be provided to the inner circumferential surface of the tubular body. When the means for supporting the inner circumferential surface of the tubular body is disposed, the pressing force by the pressure forming rolls 6 or the dies is exerted more effectively to the tubular body. In the case of using the plug 18, it is effective to circulate water or the like for cooling the inside of the plug.

Figure 7:
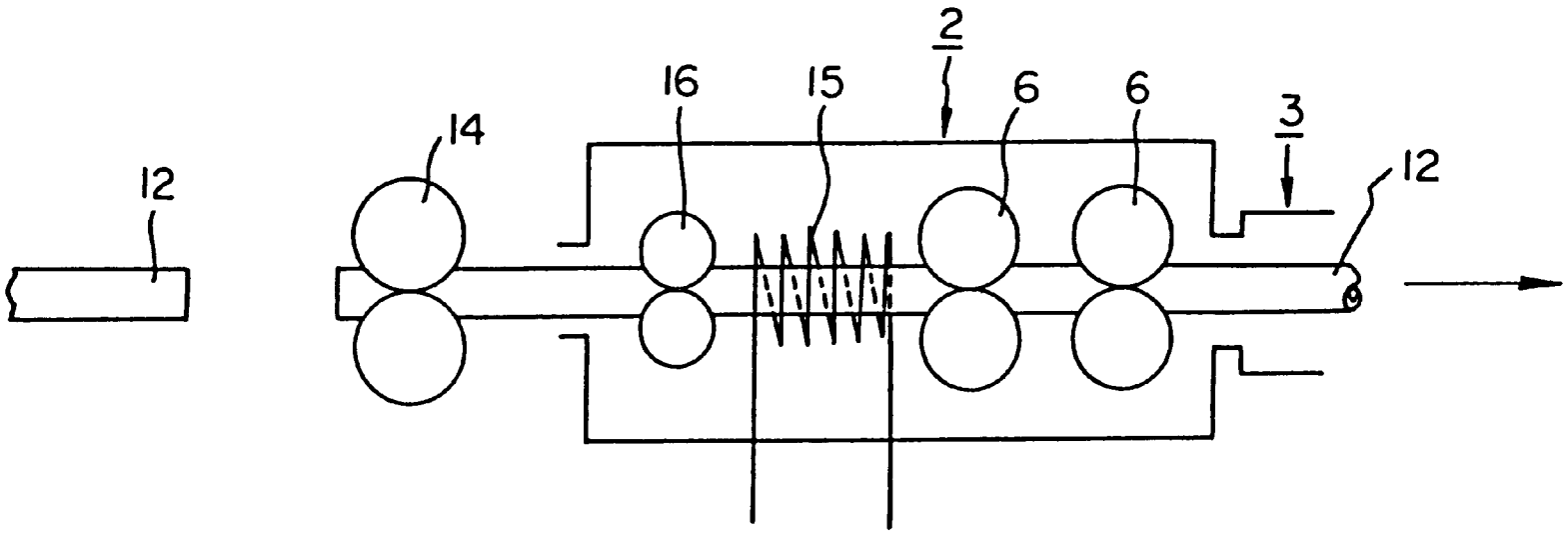
FIG. 7 is a schematic view illustrating a portion of an apparatus of another example according to the present invention.

Further, an apparatus for forming the multi-wound tubular body, melting the brazing material and cooling the brazing material continuously from the hoop material 11 up to the manufacture of the multi-wound metal tube is shown in the foregoing embodiment. However, it may have an alternative constitution, for example, as shown in FIG. 7 of forming a multi-wound tubular body 12, then cutting it into a predetermined length, delivering the thus cut tubular body into a predetermined length by a delivery roll 14 into a heating device 2, melting a brazing material and then cooling and coagulating the molten brazing material by a cooling device 3. In the example shown in FIG. 7, since tubular bodies formed efficiently at high speed and cut into a predetermined length by using an existent apparatus for forming multi-wound tubular body can be mass-produced into multi-wound metal tubes by using a plurality of apparatus for manufacturing multi-wound metal tubes according to the present invention, the productivity can be improved remarkably.

Then, the present invention is to be described by way of a second embodiment with reference to FIG. 8 to FIG. 12.

Figure 8:
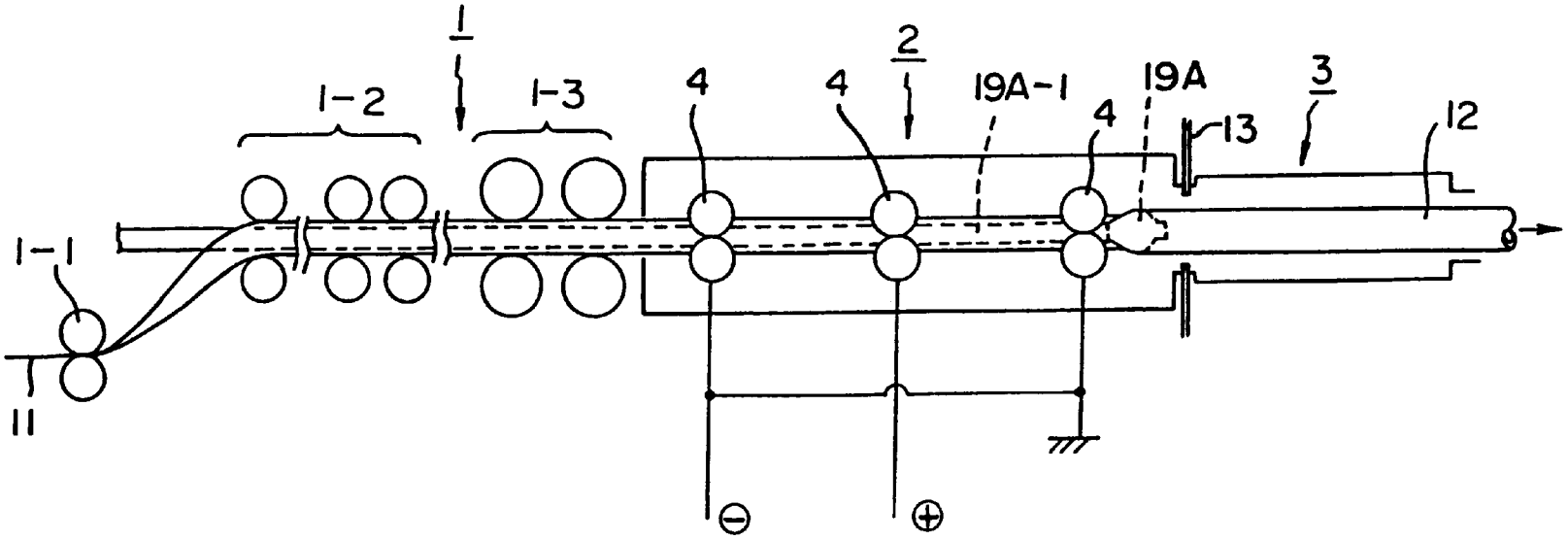
FIG. 8 is a schematic view illustrating an entire constitution of an apparatus as an example of a second embodiment according to the present invention.
Figure 9A:
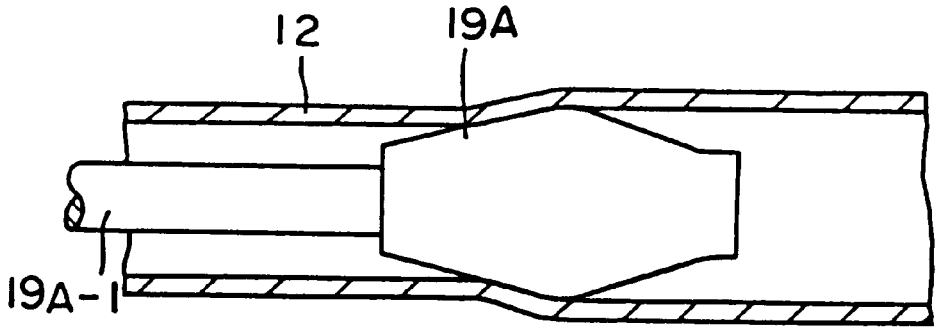
FIGS. 9(A) and 9(B) are enlarged views illustrating a pressure welding means for a multi-wound tubular body in the apparatus described above shown in FIG. 8 in which (A) shows a plug and (B) shows a mechanical tube diameter enlarging head, respectively.
Figure 9B:
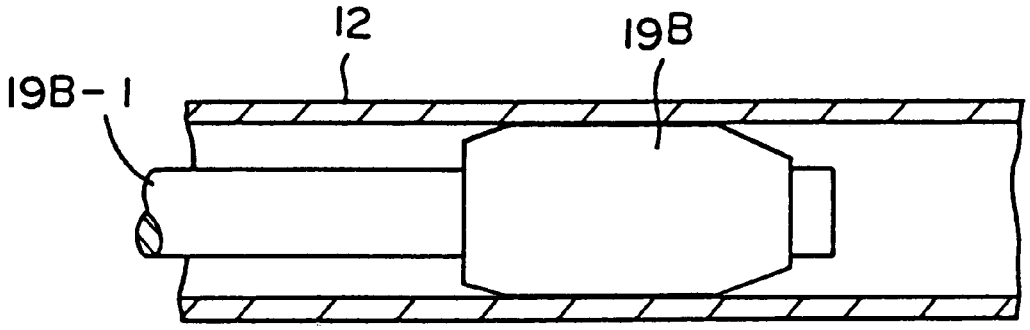
Figure 10:
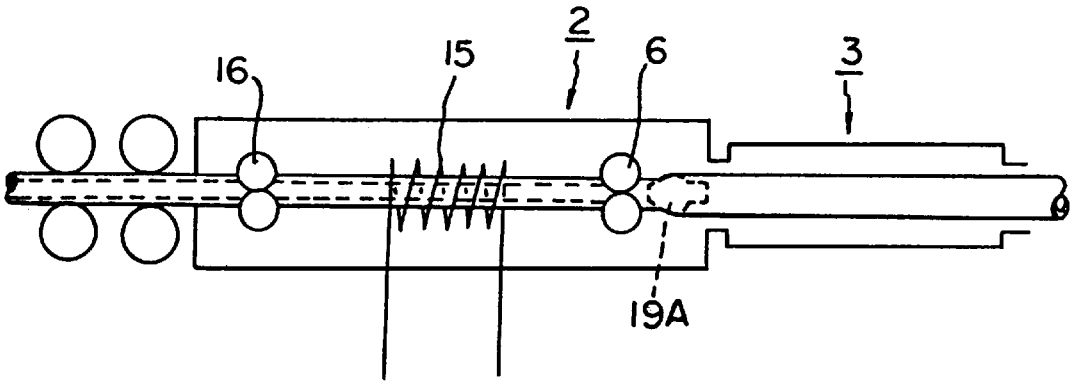
FIG. 10 is a schematic view illustrating an apparatus of adopting a high frequency heating coil system in place of an ohmic heat generating system as a heating means for a multi-wound tubular body in the apparatus described above.

FIG. 8 is a schematic view illustrating an entire constitution of an apparatus as an example according to the present invention and FIGS. 9(A) and 9(B) are enlarged views of a pressure welding means of a multi-wound tubular body in the apparatus described above in which FIG. 9(A) shows a plug and FIG. 9(B) shows a mechanical tube enlarging head respectively, FIG. 10 is a schematic view illustrating an apparatus employing a high frequency heating coil system instead of the ohmic heat generation system for the heating means of the multi-wound tubular body in the apparatus described above, FIG. 11 is a schematic view illustrating a device having a pressing rolls just before pressure welding means for the multi-wound metal tube in the apparatus described above and FIG. 12 is a schematic view illustrating a device having pressing rolls disposed just after the pressure welding means for the multi-wound metal tube. In this embodiment, different from the first embodiment, a plug 19A or a mechanical tube enlarging head 19B is disposed for pressing the inner circumferential surface of the multi-wound tubular body 12 from the inside as a means for pressure welding the walls of the multi-wound tubular body 12 to each other in the radial direction while the brazing material is still kept at a flowable temperature by heating. In FIG. 8 to FIG. 12, identical members with those in the first embodiment carry the same reference numerals.

In the multi-wound tube forming apparatus 1, are disposed successively, guide rolls 1-1 for guiding a hoop material 11 to be formed into a multi-wound tube to a forming step, and a plurality pair of tube-making or forming rolls 1-2, and finishing shaping rolls 1-3 for forming the hoop material 11 from a plate-shape into a multi-wound tube successively.

A plug 19A used in this embodiment is mounted to a support rod 19A-1 inserted from yet opened both edges of the hoop material 11 into the multi-wound tubular body above the guide rolls 1-1 (refer to FIG. 9(A)), and has a structure of uniformly pressing, radially from the outside, the inner circumferential surface of the multi-wound tubular body 12 formed by the forming apparatus 1. Further, the plug 19A may have a water cooling structure as a primary cooling means for cooling the multi-wound tubular body as rapidly as possible, and the plug 19A of the water cooling structure quenches the brazing material in the molten state approximately to the coagulation point and, preferably, below the coagulation point of the brazing material.

Further, a mechanical tube enlarging head 19B is attached to the top end of a horn 19B-1 inserted from the yet opened both edges of the hoop material 11 into the multi-wound tubular body above the guide rolls 1-1, like that the plug 19A (refer to FIG. 9(B)). As is well-known, the head 19B has such a structure that a cone connected with a main cylinder by a draw bar in the horn is pulled axially by a hydraulic pressure to expand a jaw by an wedging effect of the cone and the jaw, and the die attached to the outside of the jaw expands the multi-wound tubular body 12.

Since pressing has to be started while the brazing material between the walls of the multi-wound tubular body is still in the molten state, the plug 19A or the mechanical tube enlarging head 19B is set at a location between the inside of the heating device 3 and the inlet of the cooling device 3.

Further, as the primary cooling means for cooling the multi-wound tubular body 12 as rapidly as possible, a cooling medium spray nozzle 13 may be disposed just after the plug 19A or the mechanical tube enlarging head 19B, in addition to the water cooling plug 19A, and the cooling medium may be sprayed from the nozzle 13 to quench the brazing material approximately to the coagulation point.

As described above, while the cooling device preferably includes primary cooling means comprising the water cooling type plug 19A or the nozzle 13 and the secondary cooling means comprising the cooling device disposed at the downstream of the plug or the cooling medium spray nozzle, but quenching of the brazing material approximately to the coagulation point and cooling of the multi-wound tubular body may be conducted simultaneously also in the cooling device 3 like that in the first embodiment.

In the heating device 2 having the same function and the constitution as those in the first embodiment, the multi-wound tubular body 12 is uniformly pressed radially from the inside by the plug 19A of the mechanical tube enlarging head 19B while the brazing material is still in the molten state and walls of the multi-wound tube are pressure welded with each other in the radial direction by the pressing. In this case, since the brazing material is still in the molten state, the brazing material prevails between the walls by the pressing action of the plug 19A or the mechanical tube enlarging head 19A, to reduce gaps in which the brazing material is not present and the brazing material is squeezed out to the outer seam portion to fill the portion with the brazing material thereby reducing or eliminating the step.

Further, when the plug 19A of the water cooling structure and/or the cooling medium spray nozzle 13 is used, the molten brazing material is quenched approximately to the coagulation point and, preferably, below the coagulation point of the brazing material. Brazing sag can be prevented by such primary cooling effect, the pressure welding between the walls can be maintained and crystal grain growth can be suppressed.

The multi-wound tubular body 12 delivered from the heating device 2 is put to secondary cooling by the cooling device disposed at the downstream of the plug 19A or the mechanical tube enlarging head 19B, by which the brazing material between each of the walls is thoroughly coagulated to complete the brazing.

Figure 11:
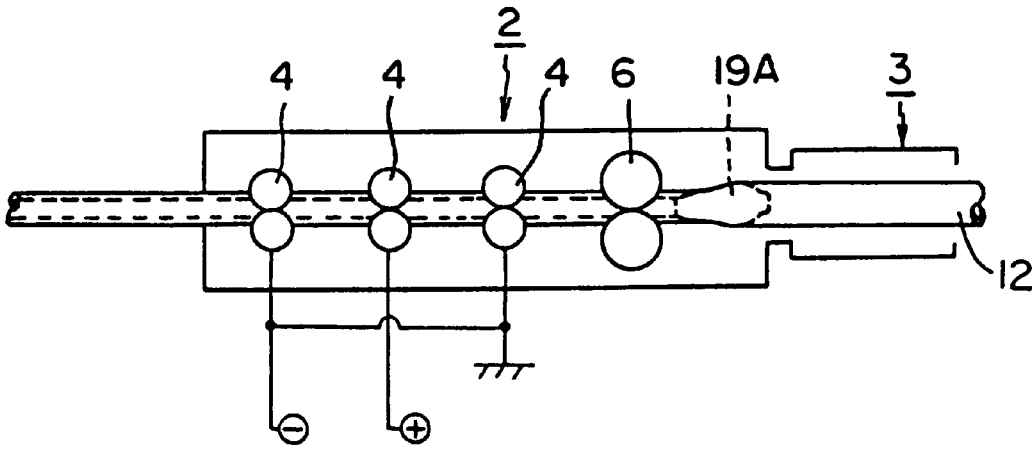
FIG. 11 is a schematic view illustrating an apparatus in which pressing rolls are disposed just before a pressure welding means for a multi-wound metal tube in the apparatus described above.
Figure 12:
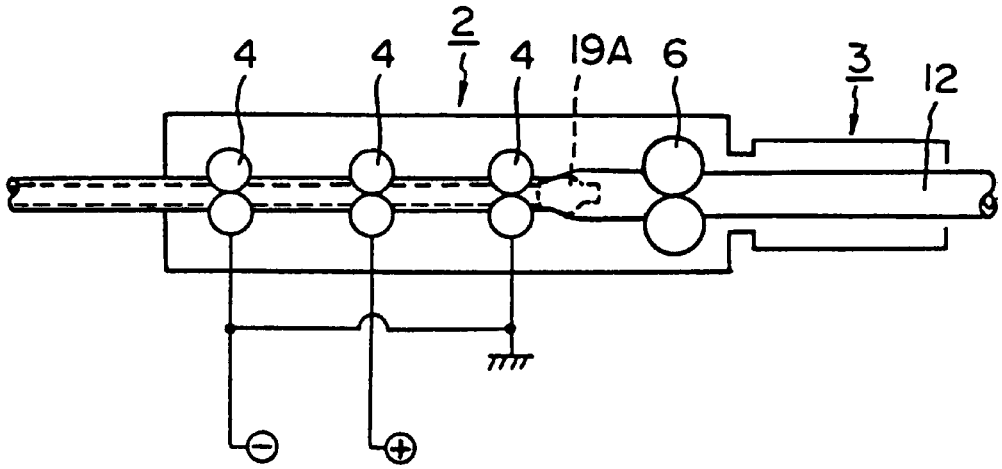
FIG. 12 is a schematic view illustrating an apparatus in which pressing rolls are disposed just after a pressure welding means for a multi-wound metal tube in the apparatus described above.

Also in this embodiment, a high frequency heating coil 15 can be adopted, as shown in FIG. 10, in place of the ohmic heat generating system as the heating means for the multi-wound tubular body 12. In this case, since the current supply rolls are not necessary, it may suffice to provide only the guide rolls 16 at the inlet and the exit of the heating device. Further, as the heating means for the multi-wound tubular body, a usual heating furnace known, for example, in JP-B-2904613 may be used as a brazing furnace. Further, in a case of providing the pressing rolls 6 as shown in FIG. 2 just before or just after the pressure-molding plug 19A of the multi-wound tubular body, as shown in FIGS. 11 and 12, since one end of the outermost wall (seam portion) of the multi-wound tubular body is forcedly pressed by the pressure forming rolls 6 from the outside, it fits and closely adheres with the inner wall to prevent peeling of the outer seam portion more effectively. Further the pressing rolls 6 may be replaced with the dies as shown in FIG. 3.

Then, the present invention is to be explained by way of a third embodiment with reference to FIG. 13 to FIG. 17.

Figure 13:
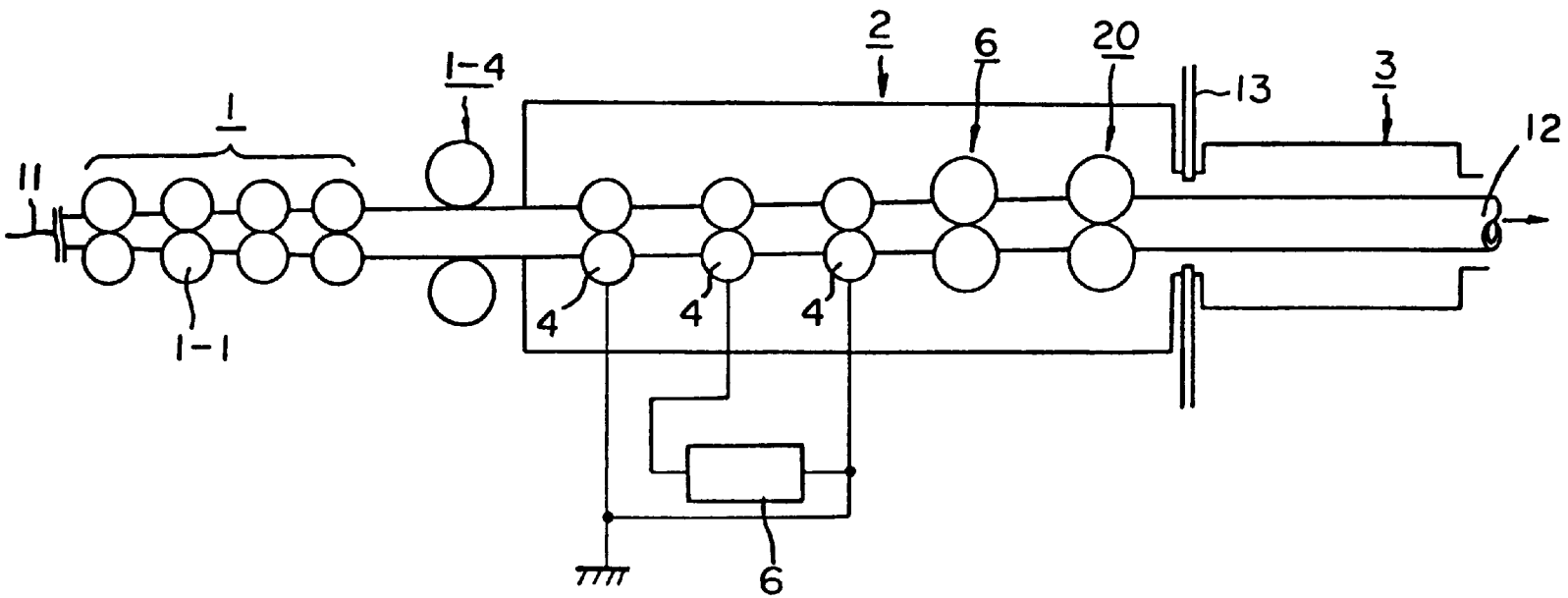
FIG. 13 is a schematic view illustrating an entire constitution of an apparatus as an example of a third embodiment according to the present invention.
Figure 14:
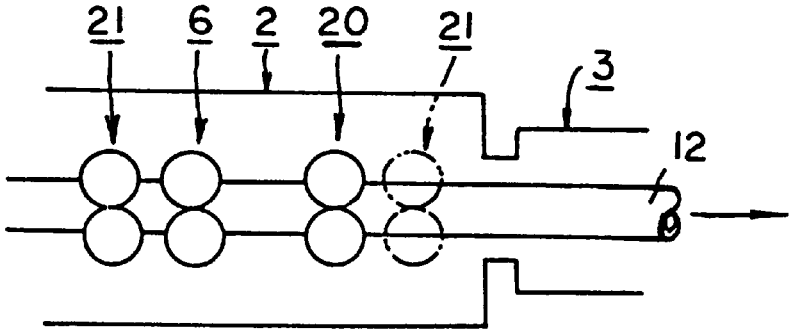
FIG. 14 is a schematic view illustrating another example of a tubular body pressure welding section in the apparatus described above.
Figure 16:
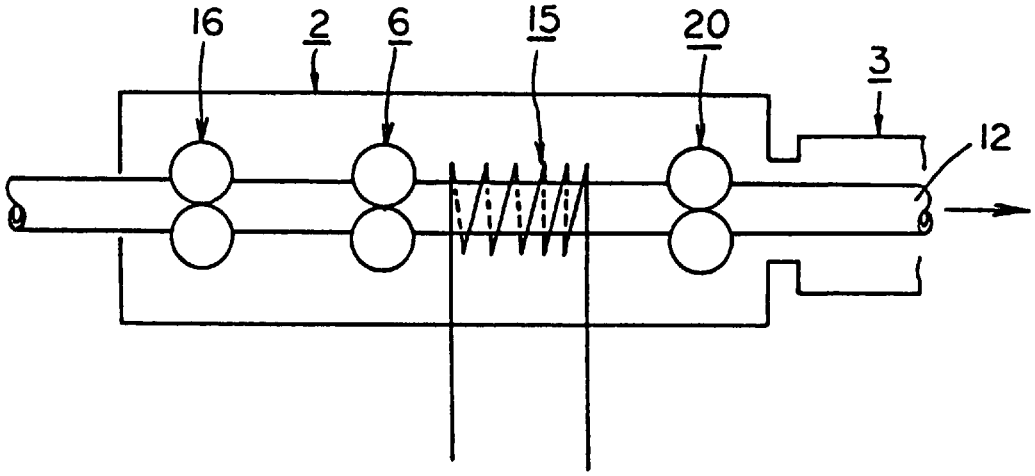
FIG. 16 is a schematic view illustrating a portion of a further example in the apparatus described above.
Figure 17:
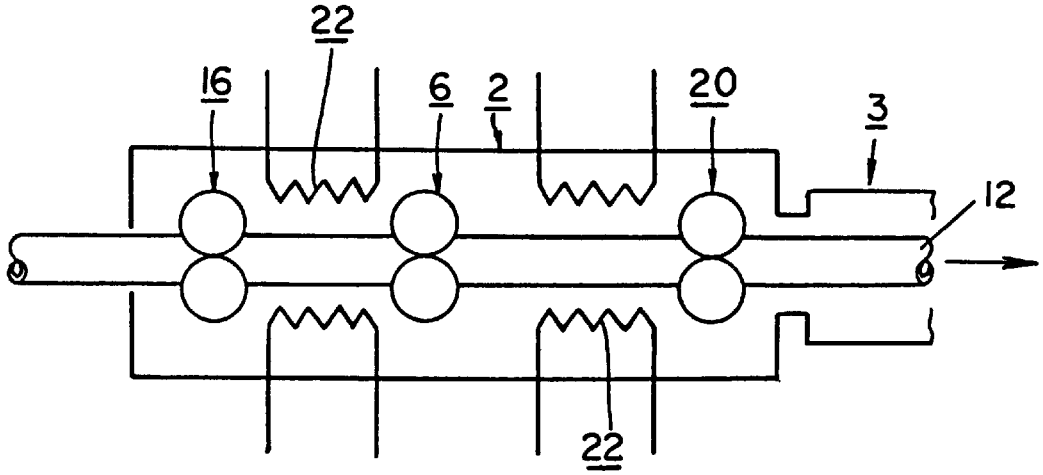
FIG. 17 is a schematic view illustrating a portion of a still further example of the apparatus described above.

FIG. 13 is a schematic view illustrating an entire constitution of an apparatus as an example of a third embodiment, FIG. 14 is a schematic view illustrating another example for a tubular body pressure-welded portion in the apparatus described above, FIG. 15 is a schematic view illustrating another heating means for the multi-wound tubular body in the apparatus described above, FIG. 16 is a schematic view illustrating a portion of a further example of the apparatus of this embodiment, FIG. 17 is a schematic view illustrating a portion of a still further example of the apparatus of this embodiment. In the third embodiment, a transfer speed varying means comprising one or more sets of tubular body pressing rolls 6 and a set of pinch rolls 20 in adjacent with the downstream of the pressing rolls is disposed as a means for pressure welding rolls of the heated multi-wound tubular body 12 to each other in the radial direction while the brazing material is kept at the flowable temperature by heating. Also in this third embodiment, the same members as those in the first and second embodiments carry the same reference numerals.

Also in the third embodiment, the multi-wound tube forming apparatus 1 comprises, for example, a plurality stages of forming rolls 1-1, and has such a structure as forming the hoop material 1-1 uncoiled from an uncoiler (not illustrated) continuously into a cylindrical shape like that in each of the foregoing embodiments. Further, the heating device 2 for the multi-wound tubular body 12 transferred by way of the tubular body transfer rolls 1-4 adopts an ohmic heat generating system using, for example, a plurality pairs of electric current supply rolls (rotary electrodes) 4 that are properly spaced apart in the direction of line as shown in FIG. 13. The tubular body pressing rolls 6 and the pinch rolls 20 are disposed as a means for changing the transfer speed of the multi-wound tubular body 12. Among them, the tubular body pressing roll 2 is, for example, of a three-roll type structure comprising one set of three rolls 6-1 as shown in FIG. 2 and has a structure uniformly pressing, radially from the outside, the outer circumferential surface of the multi-wound tubular body 12 formed in the forming apparatus 1. The radius of curvature for the groove of the tubular body pressing roll 20 is made equal with or slightly smaller than that of the outer circumference of the multi-wound tubular body, that is, the final roll of the multi-wound forming apparatus 1, in order to exert an pressing force uniformly to the multi-wound tubular body. On the other hand pinch rolls 20 are disposed in adjacent at the downstream of the tubular body pressing rolls 6 at an appropriate space, so as to exert a tensile force on the tubular body in the direction of the tubular axis between the pinch rolls 20 and the tubular body pressing rolls 5, by making the diameter of the pinch roll 20 greater than that of the pressing roll 6 or by varying the rotating speed. The pinch roll 20 preferably made as a 3-roll type structure like that the tubular body pressing roll 6. Since the tensile force is exerted on the tubular body in the direction of the tubular axis, diameter-reducing effect is caused to the tubular body and the walls are pressure welded with each other in a molten state in which the brazing material is heated to attain flowability.

Since the walls of the multi-wound tubular body have to be pressure welded in the radial direction while the brazing material between the walls of the multi-wound tubular body 12 is still in the molten state, the tubular body pressing rolls 6 and the pinch rolls 20 are set to a location between the inside of the heating device 2 and the inlet of the cooling device 3. However, they may not necessarily be disposed just after the final current supply roll 4 as in FIG. 13, but similar function and effect can be obtained also by disposing the rolls, for example, between the final current supply roll 4 and the current supply roll 4 at the preceding stage.

A cooling medium spray nozzle 13 may be disposed just after the pinch rolls 20 as primary cooling means for cooling the multi-wound tubular body in the radial direction as rapidly as possible after the pressure welding, and the outer circumferential surface of the multi-wound tube can be quenched by spraying the cooling medium from the nozzle, and the brazing material in the molten state is quenched approximately to the coagulation point, preferably, below the coagulation point of the brazing material by the nozzle.

On the other hand, the cooling device 3 is disposed at the downstream of the tubular body pressing rolls 6 or the pinch rolls 20, adapted to quench the molten brazing material approximately to the coagulation point of the brazing material and has a structure of disposing a plurality of cooling medium spray nozzles (not illustrated) such that the outer circumference of the multi-wound tubular body can be cooled uniformly like that in each of the embodiments described previously.

The cooling device 3 preferably includes primary cooling means comprising cooling medium nozzles and secondary cooling means comprising the cooling device disposed at the downstream of the tubular body pressing rolls 6 or pinch rolls 20, but quenching approximate to the coagulation point of the brazing material and cooling for the multi-wound tube can be conducted also in the cooling device 3.

In the molten state of the brazing material, a tensile force is exerted on the tubular body in the direction of the tubular axis between the tubular body pressing roll 6 and the pinch roll 20. In this instance, since the brazing material between each of the rolls is still in the molten state, it prevails between the walls, reduces the gaps in which the brazing material is not present and the material is squeezed out to the outer seam portion to fill the portion with the brazing material thereby reducing or eliminating the step. Simultaneously, one end of the outermost wall (seam portion) of the multi-wound tubular body fits and closely adheres with the inner walls by radial pressure welding to prevent peeling of the outer seam portion.

Further, the multi-wound tubular body 12 is put to primary cooling preferably by the cooling medium spray nozzle 13 disposed preferably just after the pinch rolls 20 and the brazing material in the molten state is quenched approximately to the coagulation point, preferably, below the coagulation point of the material. Such primary cooling effect can prevent brazing sag and maintain the pressure welded state between the walls and suppress the crystal grain growth. On the other hand, the heated tubular body 12 delivered from the heating device is subjected to secondary cooling by the cooling device 3 disposed at the downstream of the pinch roll 20 by which the outer circumferential surface of the multi-wound tubular body is cooled and the brazing material between each of the walls is thoroughly coagulated to complete brazing.

Further, as another example in the third embodiment, as shown in FIG. 14, a pressing means, for example, the same three-roll type pressing rolls 21 as the tubular body pressing rolls 6 or the dies 7 as shown in FIG. 3 is disposed just before or just after the tubular body transfer speed varying means comprising the tubular roll pressing rolls 6 and the pinch rolls 20, that is, just before the tubular roller pressing rolls 6 or just after the pinch rolls 20. This can further reduce the gaps in which the brazing layer is not present between each of the walls and, in addition, the step at the outer seam portion can be eliminated more effectively.

Further, by adapting the water cooling structure for the pressing rolls 21 or the dies 7 as in the first embodiment, the pressing means can be served both as the primary cooling means for quenching the brazing material approximately to the coagulation point or, preferably, below the coagulation point of the brazing material.

Figure 15:
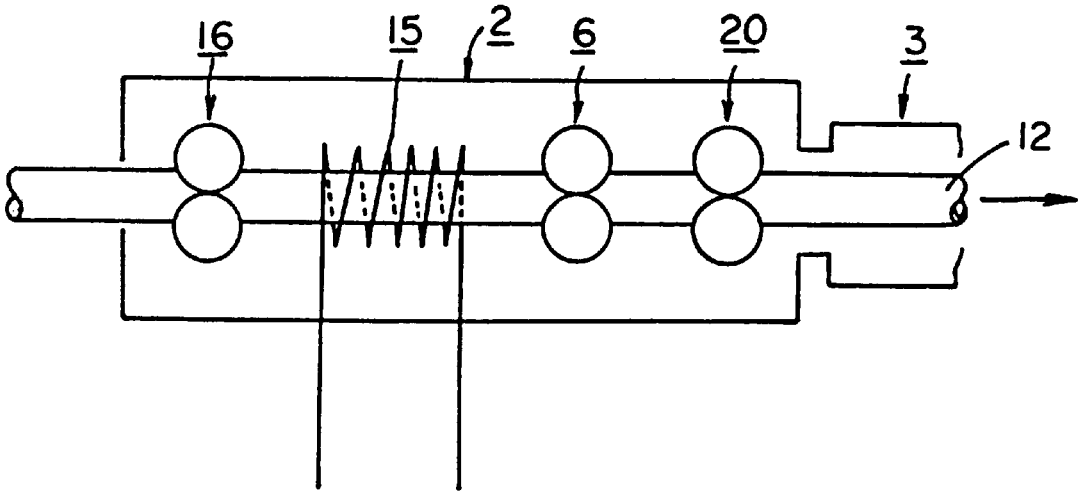
FIG. 15 is a schematic view illustrating another heating means for a multi-wound tubular body in the apparatus described above.

Further, as the heating means for the multi-wound tubular body, a high frequency coil 15 may be adopted as shown in FIG. 15 instead of the ohmic heat generation system. In this case, since no current supply rolls are required, it may suffice to provide only the guide rolls 16 at the inlet of the heating device. Further, as the heating means for the multi-wound tubular body, a usual heating furnace known, for example, in JP-B-2904613 may be used like that in each of the previous embodiments. Further, as already shown in FIG. 8, it may also adapted for forming a multi-wound tubular body 2, cutting the body into a predetermined length, delivering the tubular body cut into the predetermined length by way of delivery rolls 14 into a heating device 12 and melting the brazing material and then cooling and coagulating the molten brazing material by the cooling device 3.

Further, each of the examples shows a case of exerting the tensile force on the tubular body in the direction of the tubular axis by the tubular body pressing rolls 6 and the pinch rolls 20 after the brazing material is heated into the flowable state and then pressure welding the walls of the multi-wound tubular body with each other in the radial direction. Alternatively, the tubular main body pressing rolls 6 may be disposed at a position before or during heating of the tubular body 12 and the pinch rolls 20 may be disposed at a position where the brazing material is heated into the flowable state, and they may be abutted against the tubular body. That is, the tubular body pressing rolls are disposed to the upstream of the high frequency heating coil 15, while the pinch rolls 20 are disposed at the downstream of the coil as shown in FIG. 16. Accordingly, the brazing material is still in a solid or softened state when it passes through the tubular body pressing rolls 6, it is transformed into the flowable state after passing through the high frequency heating coil 15 and then the tensile force is applied by the pinch rolls 20. Further, in a case of a brazing furnace of applying heating by radiation/convection by an ohmic heat generation body as shown in FIG. 17, tubular body pressing rolls 6 are disposed between the ohmic heating members 22, the pinch rolls 20 are disposed to the downstream of the ohmic heating body, the tubular body 12 is abutted against the pressing rolls 6 in a state where the brazing material is softened and then the brazing material is abutted against the pinch rolls 20 in a state where the material is further heated and melted. It is important that the brazing material is brought into contact at least with the pinch rolls 20 when the material is in the flowable state.

Figure 18A:
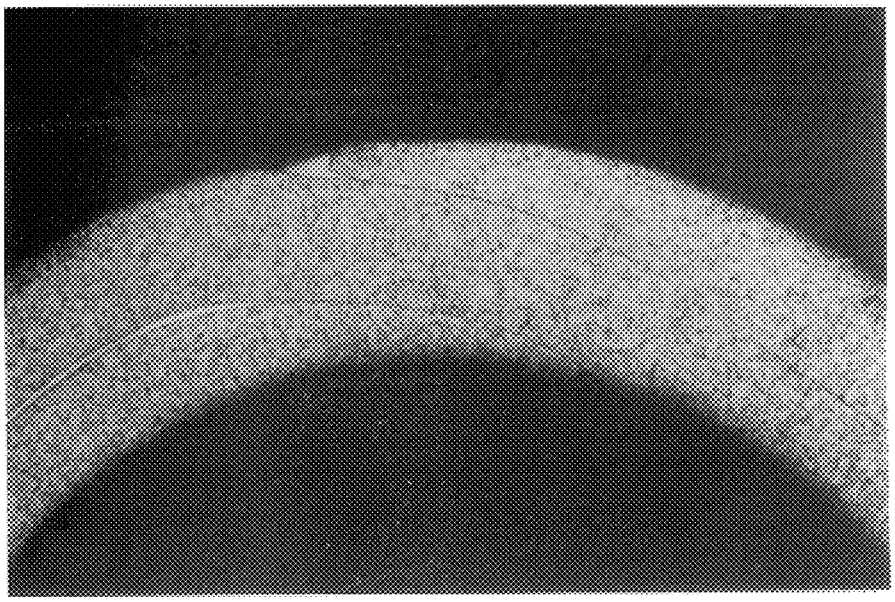
FIGS. 18(A) and 18(B) are photographs illustrating a portion of a cross sectional structure of a multi-wound tube manufactured by the apparatus according to the present invention in which (A) is a photograph illustrating a portion between walls and, (B) is an enlarged photograph for an outer seam portion.
Figure 18B:
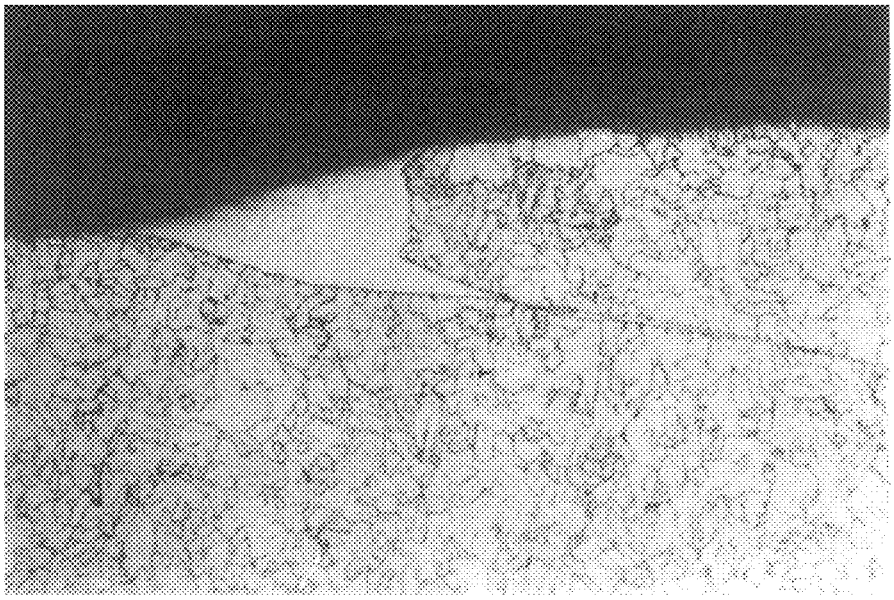

As apparent from the photographs shown in FIGS. 18(A) and (B), in the multi-wound tube according to the present invention manufactured by the apparatus for manufacturing the multi-wound tube (specifically, apparatus shown in FIG. 1), a thin copper layer of good adhesion is obtained with no gaps in which the brazing layer is not present between each of the rolls, and the outer seam portion is filled with the brazing material to obtain a high quality tube having the entire circumferential surface being formed substantially smooth.

The present invention has been explained to a case of applying brazing by pressure welding walls of a tubular body with each other in the radial direction, followed by cooling in a state in which the brazing material between the walls of the multi-wound tubular body is heated into a flowable temperature. Alternatively, brazing can be applied by pressure welding the walls with each other while the brazing material between walls of the multi-wound tubular body is heated to a temperature lower than the flowable temperature of the brazing material and higher than the softening point of the matrix material for the tubular body by various kinds of pressure welding means described with reference to the present invention and then heating the material again to fluidize the brazing material.

Figure 19:
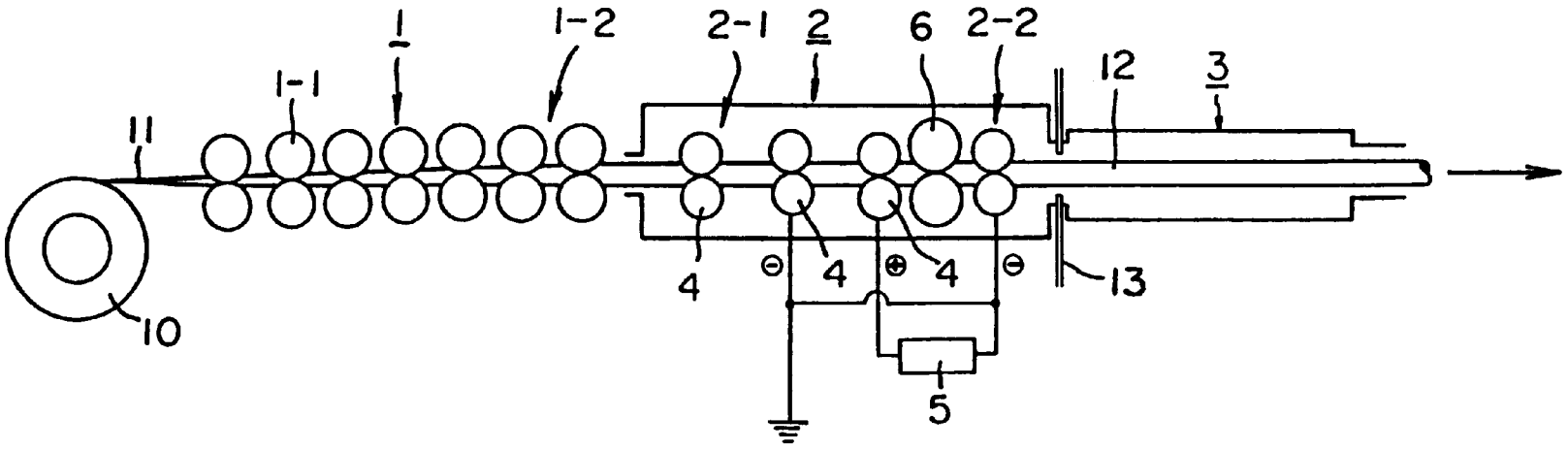
FIG. 19 is a schematic view illustrating an entire constitution of an apparatus as one example of other embodiment in accordance with the present invention.
Figure 20A:
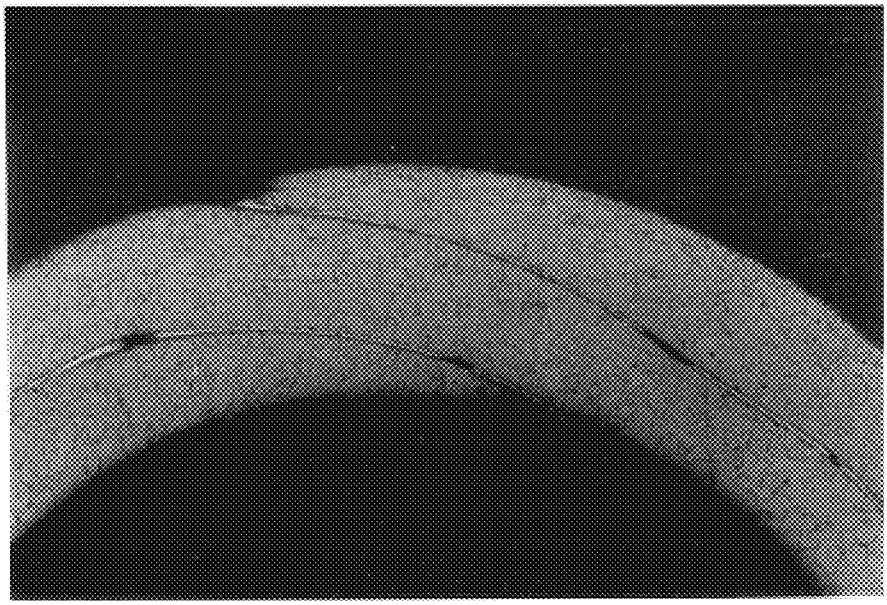
FIG. 20(A) PRIOR ART
FIGS. 20(A) and 20(B) are photographs illustrating a portion of a cross sectional structure of a multi-wound tube manufactured by an existent method in which (A) is a photograph illustrating a portion between walls and (B) is an enlarged photograph for an outer seam portion.
Figure 20B:
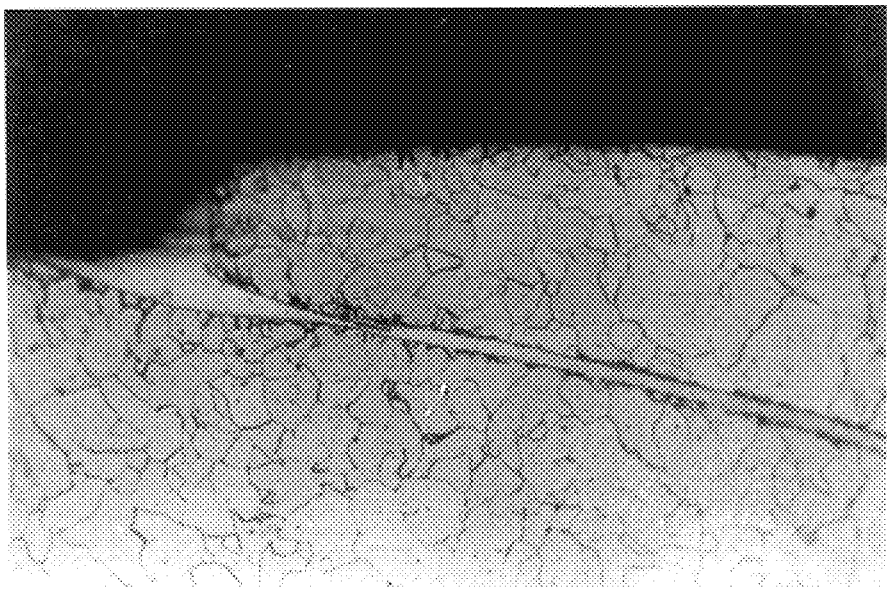
FIG. 20(B) PRIOR ART

An example of the above-mentioned embodiment is to be explained with reference to FIG. 19.

A multi-wound tube forming apparatus 1 comprises, for example, a plurality steps of forming rolls 1-1 and finishing shaping rolls 1-2. A hoop material 11 uncoiled from an uncoiler 10 is continuously formed into a cylindrical shape. Further, a heating device 2 adopts an ohmic heat generating system comprising a plurality pairs of current supply rolls (rotary electrodes) 4 which are spaced each other at an appropriate distance, for example, in the direction of the line and divided into primary heating portion 2-1 and a secondary heating portion 2-2. A non-oxidative atmosphere or a reducing gas atmosphere is present at the inside of the heating device.

The primary heating portion 2-1 partitioned separately in the heating device is adapted to heat the brazing material to a temperature lower than that for the fluidized state thereof and higher than the softening point of the substrate material of the tubular body, while the secondary heating portion 2-2 is adapted to heat the brazing material into a molten state. The heating portion 2-1 in the heating device 2 supplies electric current from a DC power source by way of a plurality pairs of electric current supply rolls 4 to the tubular body, and the brazing material is heated by the ohmic heat generation of the tubular body to a temperature lower than the flowable point of the brazing material and higher than the softening point of the substrate material for the tubular body. Since the substrate material is SPCC and the brazing material is copper, the temperature is higher than 800–850° C. and lower than 1083° C.

Successively, the multi-wound tube is pressed substantially uniformly, radially from the outside, by the pressure forming rolls 6 in the heated state and the walls of the multi-wound tube are pressure welded with each other in the radial direction by the pressing. Since the substrate material reaches the softening temperature, preferably, a recrystallization temperature in this case, even if gaps not in close adhesion with the tubular walls should be formed between the walls of the tubular body upon forming the tubular body at a normal temperature owing to abrasion of the forming tool incorporated into the forming apparatus 1, incomplete adjustment for the forming apparatus, scattering of mechanical properties or the size for each of the portions of the elongate coiled hoop material 11, and work-hardening of the substrate material by the forming step, the walls of the multi-wound tubular body 12 are pressure welded with each other by the softening of the substrate material to eliminate the gaps by the close adhesion of the brazing material layer between each of the walls.

Subsequently, the brazing material is brought into a molten state, prevails between the walls of the multi-wound tubular body and is brazed in a state in which the inner wall is more fitted and closely adhered by the secondary heating portion 2-2 having a similar heating device with that of the primary heating portion 2-1 and brazed such that gaps in which the brazing layer is not present between each of the walls are eliminated to prevent peeling at one end of inner and outer walls (seam portion) of the multi-wound tubular body.

As other pressure-welding means, heating device and cooling device to be used in this embodiment, those used in each of the previous embodiments can be applied as they are.

As has been described above, according to the present invention, the following advantageous effects can be provided.

(1) Since a multi-wound metal tube in which the outer seam portion is filled with the brazing material to fill the gap and the entire outer circumferential surface is formed substantially smooth can be obtained, when a resin tube or an O-ring is externally fitted over the multi-wound metal tube, no gaps are formed between the inner circumferential surface of such member and the tube to obtain a multi-wound metal tube of high sealing performance.

(2) Since the walls are pressure welded with each other in the molten state of the brazing material, it is possible to obtain a multi-wound metal tube of satisfactory adhesion with less gaps in which the brazing material is not present between each of the walls.

(3) Even if gaps should be formed between the walls of the multi-wound layers owing to abrasion of the forming tool and scattering of mechanical property and the size for each of the portions of the hoop material in the multi-wound forming step, peeling between the inner and outer seam portions can be prevented.

(4) Since the primary cooling for the multi-wound tubular body is conducted simultaneously or as rapidly as possible after the radial pressure welding, brazing sag can be prevented to obtain a smooth outer surface, which can facilitate subsequent plating treatment or the like and enables to maintain the pressure welded state between the walls and suppress the crystal grain growth.

(5) Since the walls are pressure welded with each other again after or during releasing of residual stresses by heating in the substrate material owing to forming, it is no more necessary to select material considering scattering or the like for the mechanical properties such as spring back and the size for each of the portions of the hoop material, the range for selecting the materials can be extended.

(6) Since the walls of the multi-wound metal tube are brazed to each other in a state pressure welded with each other in the radial direction, the thickness of the brazing material layer can be reduced and, accordingly, it is possible to reduce the embrittlement along with increase of the brazing material layer and the amount of the brazing material used can be reduced.

What is claimed is:

1. A multi-wound metal tube having a cylindrical shape with an outer circumferential smooth surface, said tube comprising a length of hoop material wound to define inner and outer walls with portions of said hoop material defining said outer wall being spaced apart to define an outer seam, said hoop material having inner and outer surfaces, said outer seam being filled with brazing material, said brazing material and said portions of said hoop material defining said outer wall collectively defining the outer circumferential smooth surface of the tube, and said brazing material also being disposed between and in full engagement with said inner surface of said portions of said hoop material defining said outer wall and said outer surface of portions of said hoop material defining said inner wall such that there are no gaps therebetween.

2. A multi-wound metal tube having a cylindrical shape with an outer circumferential smooth surface, said tube comprising a length of hoop material having inner and outer surfaces, said hoop material being wound to define inner and outer walls and being pressed in a radially inward direction to compress the walls of the multi-wound tube in a peripheral direction, portions of said hoop material defining said outer wall being spaced apart to define an outer seam, said outer seam being filled with brazing material, said brazing material and said portions of said hoop material defining said outer wall collectively defining the outer circumferential smooth surface of the tube, said brazing material being disposed between and in full engagement with said inner surface of said portions of said hoop material defining said outer wall and said outer surface of portions of said hoop material defining said inner wall such that there are no gaps therebetween.

* * * * *